US008579006B2

(12) United States Patent
Levin

(10) Patent No.: US 8,579,006 B2
(45) Date of Patent: Nov. 12, 2013

(54) SPACE DIVIDER SYSTEM

(76) Inventor: Adrian Mario Levin, New York City, NY (US)

( * ) Notice: Subject to any disclaimer, the term of this patent is extended or adjusted under 35 U.S.C. 154(b) by 55 days.

(21) Appl. No.: 13/281,752

(22) Filed: Oct. 26, 2011

(65) Prior Publication Data

US 2012/0318467 A1 Dec. 20, 2012

Related U.S. Application Data

(63) Continuation-in-part of application No. 29/343,526, filed on Oct. 19, 2009, now abandoned.

(51) Int. Cl.
*E05D 15/08* (2006.01)

(52) U.S. Cl.
USPC ..... 160/184; 160/197

(58) Field of Classification Search
USPC ..... 160/184, 197, 200; 52/64; 49/409, 425, 49/427; 16/94 R, 94 D, 95 R, 95 D
See application file for complete search history.

(56) References Cited

U.S. PATENT DOCUMENTS

| | | | | |
|---|---|---|---|---|
| 1,689,665 | A | 10/1928 | Cramp | |
| 2,093,708 | A * | 9/1937 | Breuer | 16/95 D |
| 2,614,626 | A | 10/1952 | Garcia | |
| 2,732,919 | A * | 1/1956 | Johnson | 49/372 |
| 2,930,072 | A | 3/1960 | Light | |
| 3,260,303 | A | 7/1966 | John | |
| 3,348,603 | A | 10/1967 | Ford | |
| 3,460,290 | A * | 8/1969 | Wutzke | 49/411 |
| 3,642,051 | A | 2/1972 | Goldner | |
| 3,878,583 | A * | 4/1975 | Smart | 16/95 R |
| 3,911,991 | A * | 10/1975 | Malferrari | 160/202 |
| 4,023,235 | A * | 5/1977 | Cohen et al. | 16/94 D |
| D254,120 | S | 2/1980 | Lang | |
| 4,221,255 | A | 9/1980 | Barkemeyer | |
| D292,318 | S | 10/1987 | Martinelli | |
| 4,742,645 | A * | 5/1988 | Johnston | 49/372 |
| 5,016,318 | A | 5/1991 | Harris | |
| 5,109,910 | A | 5/1992 | Tortorella | |
| 5,232,039 | A | 8/1993 | Shapiro | |
| 5,406,761 | A | 4/1995 | Hobbiebrunken et al. | |
| 5,819,833 | A | 10/1998 | Swiszcz et al. | |
| 5,899,303 | A | 5/1999 | Allen | |
| 6,018,915 | A * | 2/2000 | Pomish et al. | 52/64 |

(Continued)

OTHER PUBLICATIONS

Hafele, Hafele GmbH & Co KG, Top Hung System, HAWA-Junior 40/GS.

(Continued)

*Primary Examiner* — David Purol
(74) *Attorney, Agent, or Firm* — Michael E. Zall

(57) ABSTRACT

A space divider system having a track beam with opposed ends and parallel tracks along its length. The ends are removably mounted to opposed walls, below the ceiling without intermediate support. Light weight substantially frameless, translucent/transparent panels are provided to allow uninterrupted passage of light. The top edge of each panel is slidably mounted to a track of the track beam, sliding between the opposed walls on its own track, independently of the other panels. The planar surfaces of the panels are parallel to the track beam and the bottom edges are spaced a distance from the floor. The widths of the panels when added together are at least equal to the length of the track beam and can be positioned along the beam to permit complete closure of the space between the walls or to overlap each other to provide an opening through the space between the walls.

8 Claims, 10 Drawing Sheets

(56) References Cited

U.S. PATENT DOCUMENTS

| | | | | |
|---|---|---|---|---|
| 6,098,342 | A | 8/2000 | Bischof | |
| 6,352,097 | B1 | 3/2002 | Kern et al. | |
| 6,360,487 | B1 | 3/2002 | Kern et al. | |
| 6,393,772 | B1 | 5/2002 | McRoberts et al. | |
| 6,557,303 | B2 | 5/2003 | Finke | |
| 6,581,242 | B2 | 6/2003 | Owens | |
| 6,761,782 | B2 | 7/2004 | Swiszcz et al. | |
| 6,848,214 | B2 | 2/2005 | Bischof | |
| 6,892,783 | B1 * | 5/2005 | Comeau et al. | 160/126 |
| 6,923,238 | B2 | 8/2005 | Kern et al. | |
| 7,174,944 | B1 | 2/2007 | Clark | |
| D540,473 | S | 4/2007 | Loggen | |
| D546,971 | S | 7/2007 | Bell et al. | |
| 7,350,244 | B1 | 4/2008 | Handley | |
| 7,504,159 | B1 | 3/2009 | Suare et al. | |
| 7,568,311 | B2 | 8/2009 | Shivak et al. | |
| D604,428 | S | 11/2009 | Waters | |
| 7,691,486 | B1 | 4/2010 | Suare et al. | |
| 7,743,558 | B2 | 6/2010 | Jakob-Bamberg et al. | |
| 7,958,926 | B2 | 6/2011 | Colson et al. | |
| 2008/0196206 | A1 | 8/2008 | Chen | |
| 2010/0071857 | A1 * | 3/2010 | Hung | 160/97 |
| 2010/0101150 | A1 | 4/2010 | Huang | |
| 2010/0139037 | A1 | 6/2010 | Hufen et al. | |
| 2010/0143662 | A1 | 6/2010 | Suare et al. | |
| 2011/0226424 | A1 | 9/2011 | Willham | |

OTHER PUBLICATIONS

3form Struttura, fizz, float, pep stage.
3form varia ecoresin.

* cited by examiner

SPACE DIVIDER SYSTEM

RELATED APPLICATION

This application is a continuation-in-part of U.S. Ser. No. 29/343,526 filed on Oct. 19, 2009 entitled FRAMELESS SUSPENDED SLIDING PANELS, now abandoned. The entire disclosure of this application is incorporated herein by reference.

BACKGROUND OF THE INVENTION

1. Field of the Invention

This invention relates generally to the field of sliding panel space divider systems for rooms. More specifically, this invention relates to a sliding panel space divider system that is easy to install between walls of a room or within a door frame, that is light weight and has panels that are translucent or transparent to permit the passage of light in the room(s) within which such system is installed.

2. Related Art

There are many different types of sliding panel systems serving the commercial and residential markets. However, most types of sliding panels utilize heavy panel materials, e.g., glass or wood, have a wood or metal frame surrounding each panel and a top and/or a bottom track system to maintain the panels in position and guide them. There are a few light weight panel systems which use framed panels and upper and lower tracks, or framed panels with upper tracks and lower guide tracks. Additionally, the widely used track beams that carry such panels, due to the weight of the panels, are typically mounted directly to the wall or ceiling along the length of the track beam.

Additionally, light polymeric resin panels are also known in the art, see for example ECORESIN® panels manufactured and sold by 3Form, Inc. (Salt Lake City, Utah). These panels are translucent thermoplastic panels that are used in decorative architectural applications, such as panels, splashes, appliance panels, shower surrounds, privacy panels, cabinet doors, raised panel inserts, flooring, office furniture panels, chairs, tables, art, stained glass type windows, signage, store displays, store fronts, transaction tops and desks (www.3-form.com). Several of 3Form's numerous US Patents and publications on these panels are U.S. Pat. No. 7,504,159 to Suare et al, 2010/0143662 to Suare, 2011/0226424 to Willham and U.S. Pat. No. 7,691,486 to Suare.

The following is a list of US Patents that may be relevant to the patentability of the herein claimed invention:

1,689,665 to Cramp
2,614,626 to Garcia
2,930,072 to Light.
3,260,303 to Pipe
3,348,603 to Ford
3,642,051 to Goldner
4,221,255 to Barkemeyer
5,016,318 to Harris
5,109,910 to Tortorella et al.
5,232,039 to Shapiro et al.
5,406,761 to Hobbiebrunken et al.
5,819,833 to Swiszcz et al.
5,899,303 to Allen
6,098,342 to Bischof et al.
6,352,097 to Kern et al.
6,360,487 to Kern et al.
6,393,772 to McRoberts et al.
6,557,303 to Finke et al.
6,581,242 to Owens -continued 6,761,782 to Swiszcz et al.
6,848,214 to Bischof et al
6,923,238 to Kern et al.
7,174,944 to Clark et al.
7,350,244 to Handley
7,568,311 to Shivak et al.
7,743,558 to Jakob-Bamberg et al.
7,762,305 to Huang
7,958,926 to Colson et al.
2008/0196206 to Chen et al.
2010/0101150 to Huang
2010/0139037 to Hufen et al.
D254,120 to Lang
D292,318 10 to Martinelli
D540,473 04 to Loggen
D546,971 07 to Bell et al.
D604,428 11 to Waters

OBJECTS AND SUMMARY OF THE INVENTION

It is an object of this invention to provide a space divider system having sliding panels that are translucent or transparent to permit the passage of light therethrough.

It is another object of this invention to provide a space divider system wherein the panels used are frameless to decrease the weight of the panels and enhance passage of light through such panels to maximize the luminosity of the interior space.

It is yet another object of this invention to provide a divider system having a track beam that is anchored only to the opposed walls at each end of the beam, is easy to install and also remove, and does not require a floor track or any modification of the ceiling or floor surfaces close to the divider system above and below the system.

All of the foregoing objects and others are achieved by a space divider system for a room having a ceiling surface, a floor surface and opposed wall surfaces that form a space between the walls. The system comprises an elongated track beam that has opposed ends and a plurality of parallel tracks along the beam length. Each end of the track beam has a means for removably mounting the end of the beam to an opposed wall surface. This enables the track beam to be mounted across the space between the walls. The track beam is mounted on the opposed walls a spaced distance below the ceiling surface.

A plurality of translucent or transparent polymeric panels is provided. Each panel has opposed planar surfaces, a top edge, a bottom edge and opposed side edges defining a width of the panel. The side edges and bottom edge of each panel are substantially frameless.

A suspension system is mounted to each panel near the top edge of the panel for slidably mounting the panel to one of the tracks of the track beam. Each panel slides between the opposed wall surfaces on its own track independently of the other panels. The planar surfaces of the panels are substantially parallel to the track beam. The panels are of a length such that the bottom edges of the panels are spaced a distance from the floor surface.

The widths of each panel are such that when added together are at least about equal to the beam length of the track beam. Thus, the panels can be positioned along the beam length to permit complete closure of the space between the walls. Also, the widths of each panel are such that they can be positioned along the beam length to overlap each other and provide openings through the space between the walls.

Other important objects and features of the invention will be apparent from the following Detailed Description of the Invention taken in connection with the accompanying drawings.

DETAILED DESCRIPTION OF THE INVENTION

Figure 1:
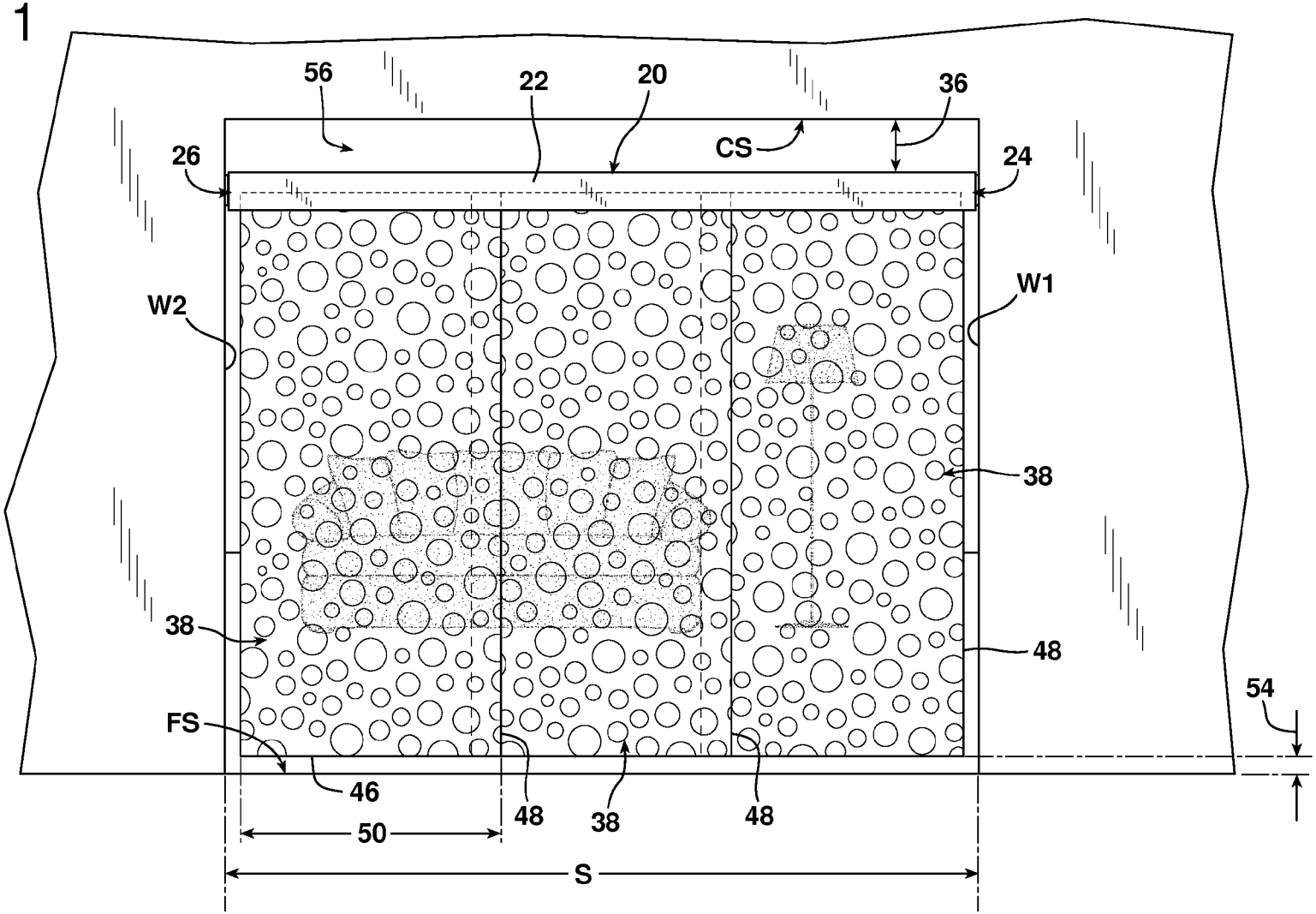
FIG. 1 is a front view of the space divider system of this invention mounted in an opening between rooms.
Figure 2:
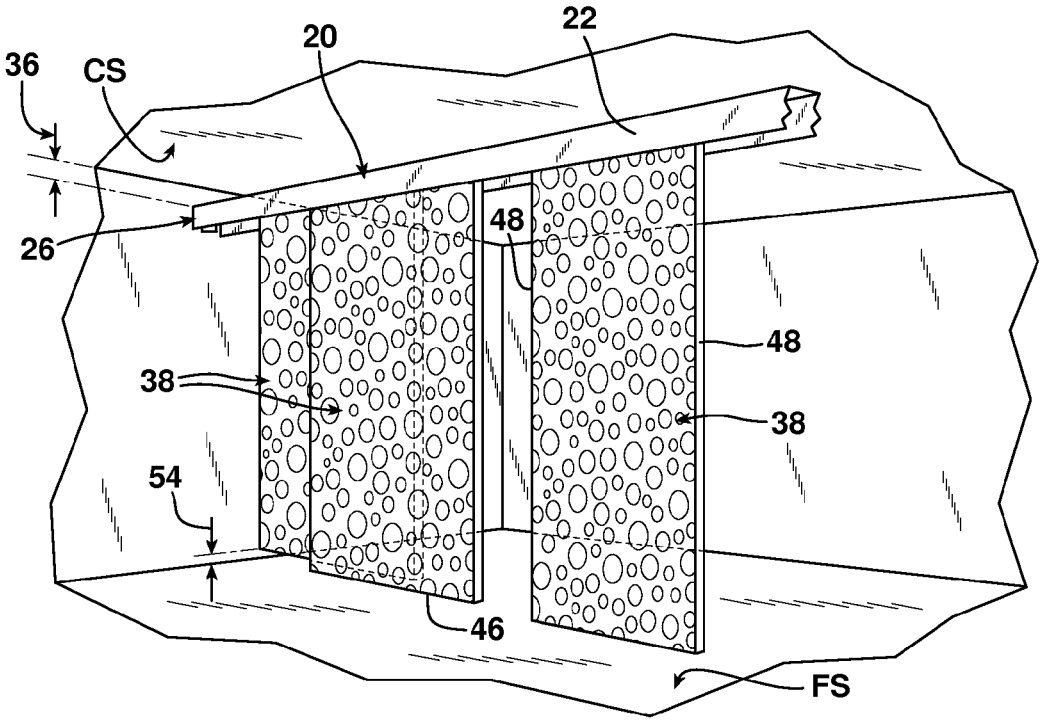
FIG. 2 is a perspective view of the space divider system of this invention mounted between walls in a room (one wall not shown).
Figure 2A:
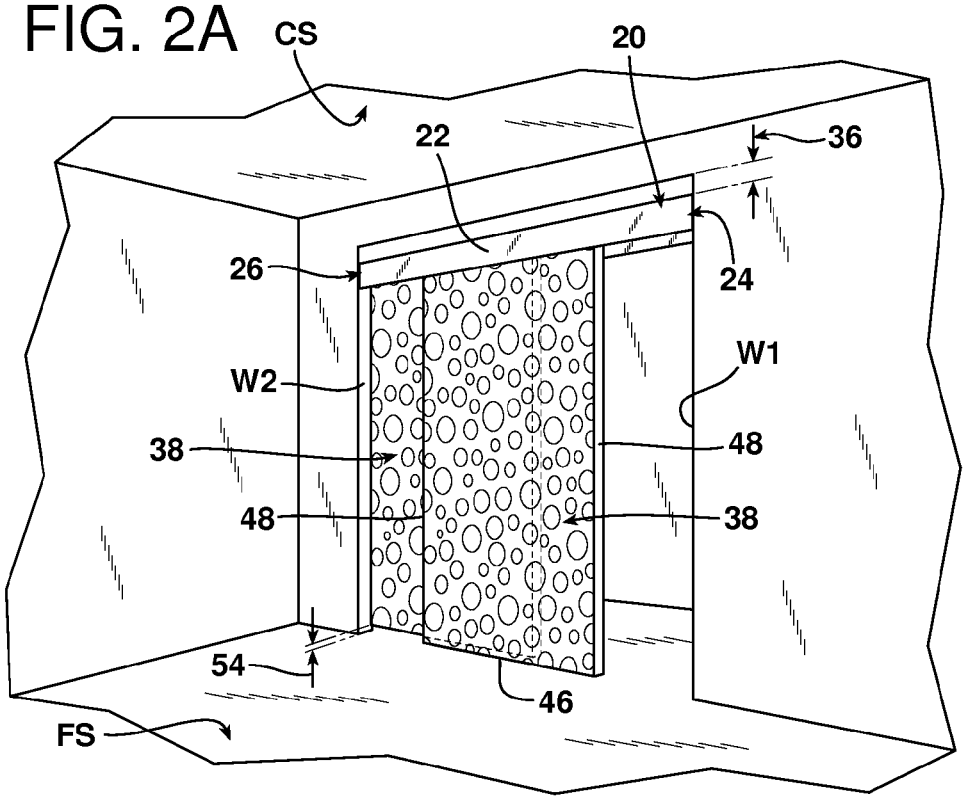
FIG. 2A is a perspective view of the space divider system of this invention mounted in an opening between rooms.

Referring to the Figures, and in particular FIGS. 1, 2 and 2A a space divider system 20 is provided for a room. The room has a ceiling surface CS, a floor surface FS and opposed wall surfaces W1, W2 that form a space S between the walls W1, W2.

It should be understood that when the space divider system 20 is used in an opening between rooms, as depicted in FIGS. 1 and 2A, when reference is made to the ceiling surface CS and/or the wall surfaces W1, W2 it is meant to include surfaces directly above the divider system CS and on the sides W1, W2 defining the opening in FIGS. 1 and 2A. For example, if an opening is defined by a door jam (not shown in the Figures) the vertical surfaces framing the opening are considered herein as wall surfaces W1, W2 and the horizontal framing above the opening is considered herein to be a ceiling surface CS.

Referring, for example, to FIGS. 1-3 and 10, the space divider system 20 includes an elongated track beam 22 that has opposed ends 24, 26. Each end 24, 26 has a means for removably mounting such end 24, 26 to an opposed wall surface W1, W2. The length of track beam 22 can vary depending on the space S that needs to be divided. Preferred lengths for the track beam 22 are between eight and sixteen feet.

As depicted in FIGS. 3, 4, 10 and 12, such removable mounting means may consist of an "L" shaped bracket 72 that has one of the legs 72A attached to the track beam 22, for example by screws 74 (see FIGS. 4 and 10) passing through the screw holes in the leg 72A and beam 22. The other leg 72B may be mounted to the wall surface W1, W2 by, for example by screws 76 passing through leg 72B (see FIGS. 4 and 10) and into the wall W1, W2. Such screws can be easily removed from the walls W1, W2 without any substantial damage to such wall.

It should be understood that numerous other systems or means could be used to removably mount the beam ends 24, 26 to the wall surfaces W1, W2 as long as such mounting means is sufficiently strong to maintain the space divider system in place during use, e.g., spring means, clips, adhesives, etc. For example, one end of the track beam 22 may be frictionally held in place by appropriate adjustment of the mounting means on the other end of the track beam 22 or by a spring mechanism (not shown) on the other end of the track beam 22.

Referring to FIGS. 1, 2, 2A, 4-9, for example, the track beam 22 spans the space S between the walls W1, W2 and is mounted a spaced distance 36 below the ceiling surface CS. Generally, such spaced distance 36 can be from ¼ inch (0.635 centimeter) to several inches, e.g., 3 inches (7.62 centimeters) to 12 inches (30.48 centimeters).

There are numerous benefits to having the opposed ends of the beam 24, 26 removably mounted to the opposed wall surfaces W1, W2 and the beam 22 being a spaced distance 36 below the ceiling surface CS. In particular, the divider system 20 is extremely easy to install in that you are not relying on any other structural elements of the system 20 other than the opposed ends 24, 26 mounted to the walls W1, W2 for lateral support. Thus any interfering infrastructures, in the room, for example on the ceiling, e.g., piping, duct work, lighting, etc., generally do not have to be considered, avoided or modified to install the divider system 20. Still further, there is no required construction or modifications required for the ceiling CS or floor FS. For example, there are no tracks or support structures that need to be installed in the ceiling CS. Additionally, because the bottom edges 46 of the panels 38 are positioned a spaced distance 54 above the floor FS (discussed below) there are no modifications or installations required in the floor surface FS. The divider system 20 of this invention is considered to be a standalone fixture and thus there is no need for building permits to install the system 20. For example, co-operative board approval is not required for installation of the system 20.

Referring to FIGS. 3-5, 10-13, the track beam 22 includes a plurality of parallel tracks 28 along the beam length 30.

Figure 3:
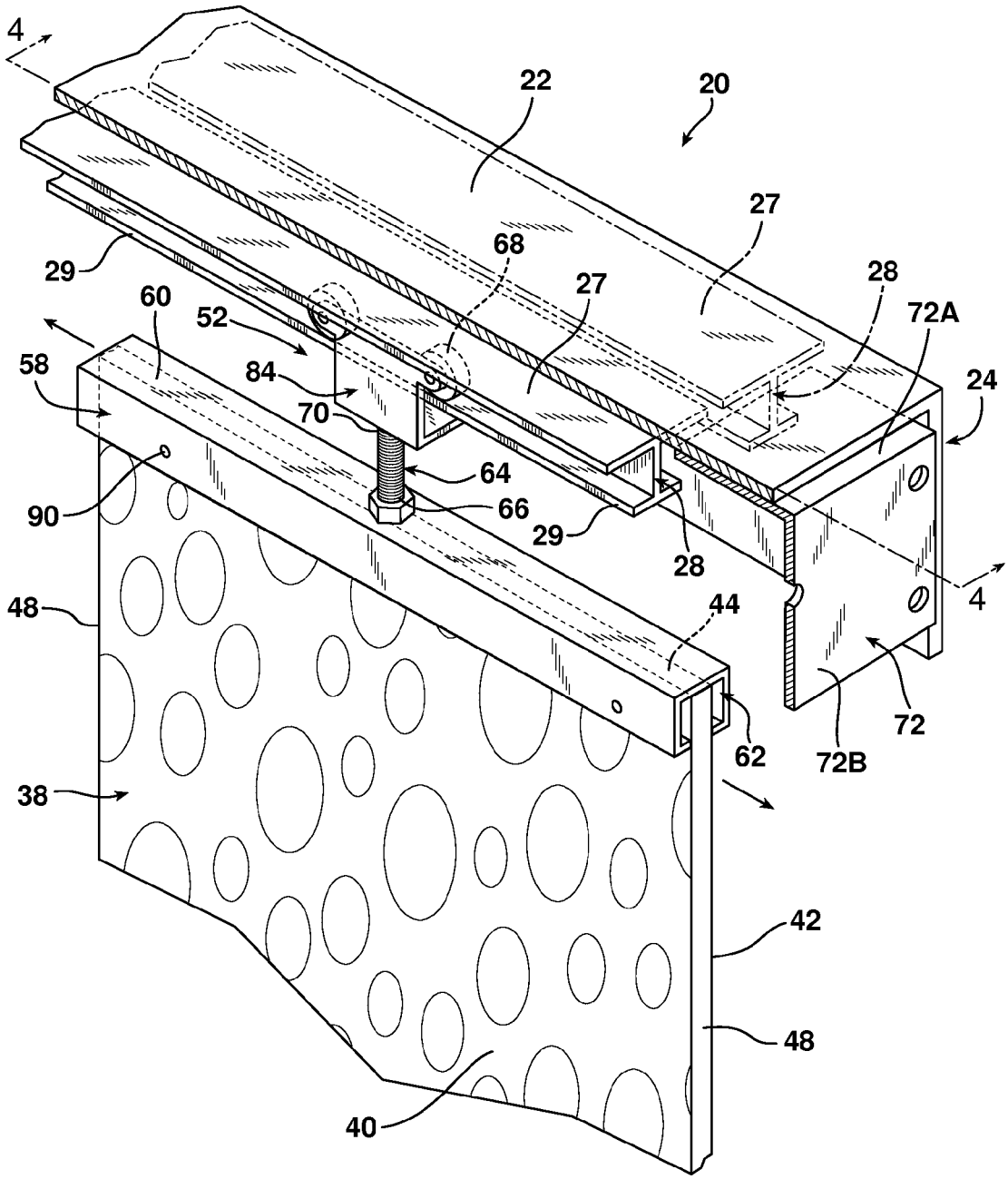
FIG. 3 is a partial perspective view of the track beam and end mounting means supporting a sliding panel used in the space divider system of this invention.
Figure 4:
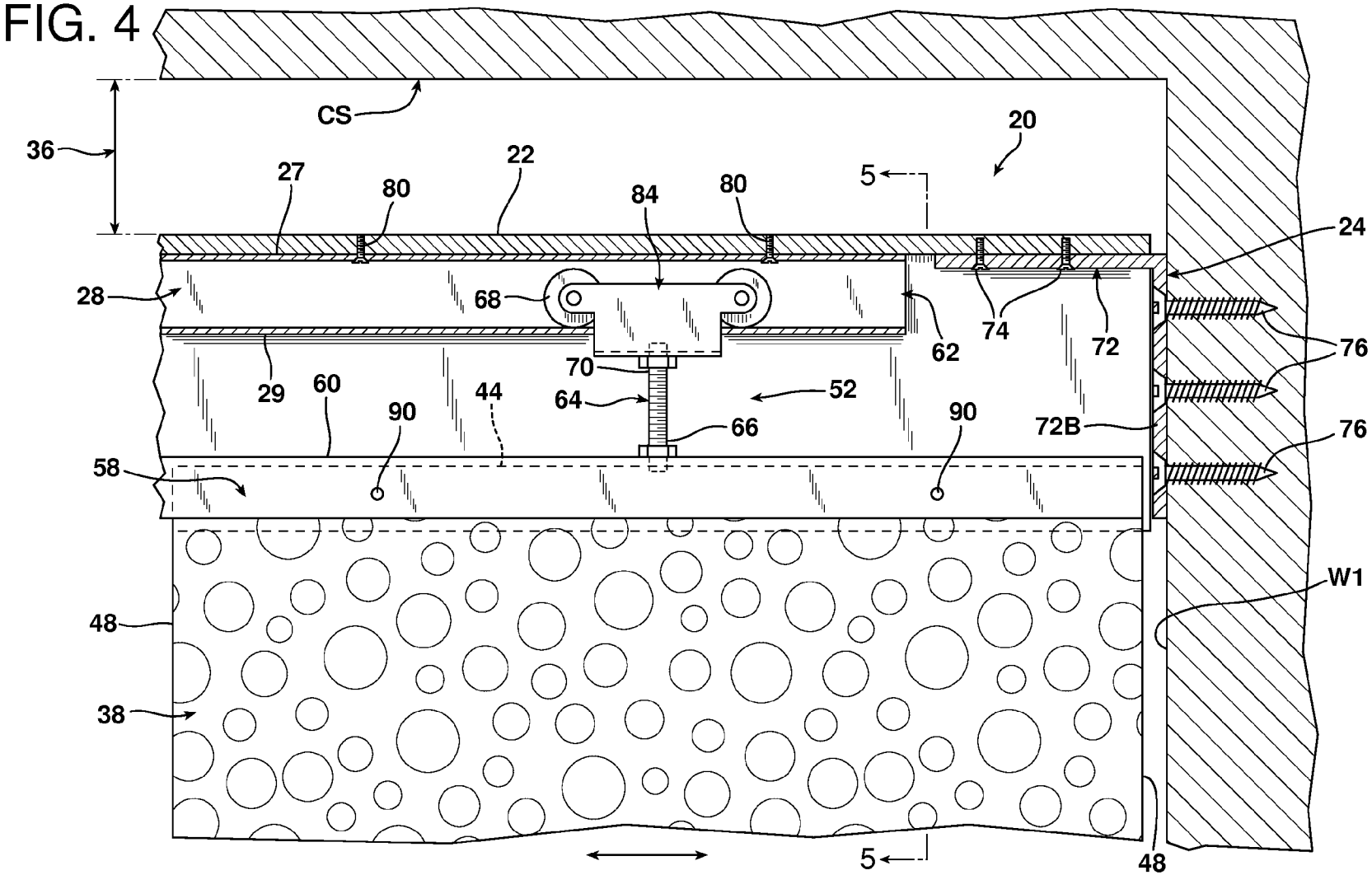
FIG. 4 is a partial cross-sectional view of the suspended track beam supporting a sliding panel of the space divider system of this invention mounted to a vertical surface, e.g., wall, taken along line 4-4 of FIG. 3.
Figure 5:
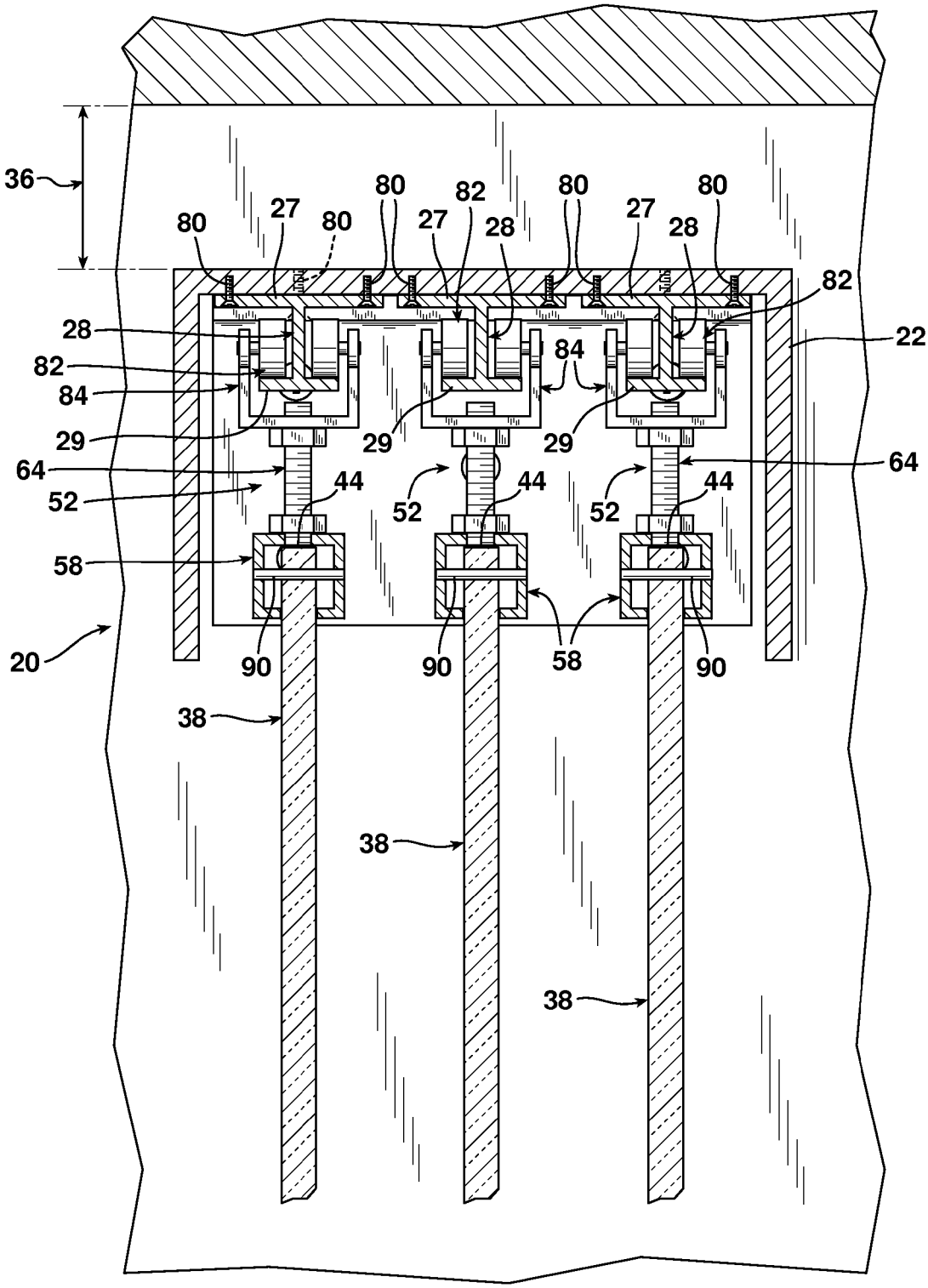
FIG. 5 is a cross-sectional view of the suspended track beam of the space divider system of this invention taken along line 5-5 of FIG. 4 showing one embodiment of a suspension system for suspending the sliding panels.

Referring to FIGS. 3-5, depicting an embodiment of this invention, the track beam 22 is a "U" shaped channel, for example 6 inches (15.24 centimeters) wide by 4 inches (10.16 centimeters) high made of 0.25 inch (0.635 centimeter) thick aluminum. The track beam 22 has mounted to the interior thereof a plurality, in this case three, tracks 28 that are parallel to each other within the track beam channel 22. Each of the tracks 28 is an aluminum "I" beam. The upper portion 27 of the track 28 is mounted by screws 80 to the interior channel of track beam channel 22. The lower portion 29 of the track 28 supports the suspension system 52 for slidably mounting the panels 38 thereon.

Referring to FIGS. 10-13, depicting another embodiment of this invention, the track beam 22 is the "U" shaped channel of FIGS. 3-5, and has mounted to the interior three tracks 28 that are parallel to each other within the track beam channel 22. Each track 28 is an inverted aluminum "C" beam, the center portion of which is mounted by screws 80 to the interior channel of track beam channel 22. The lower portion 29 supports the suspension system 52 that slidably mounts the panels 38 thereon.

Referring, to FIGS. 4-5 and 10-13, a suspension system 52 is mounted to each panel 38 near the top edge 44 of the panel 38. The suspension system 52 slidably mounts the panel 38 to a track 28 that is mounted within the track beam 22. Preferably, each track 28 extends the full length of the track beam 22 and the panel 38 mounted on such track 28 can slide the complete length of such track 28. Thus, each panel 38 can slide the full length of the space S between the opposed wall surfaces W1, W2 on its own track 28 independently of the other panels 38. The planar surfaces 40, 42 of the panels 38 are substantially parallel to the track beam 22 and remain such when they are moved along the track. The bottom edges 46 of the panels 38 are spaced a distance 54 from the floor surface FS.

The suspension system 52 generally comprises a plurality of rollers 82, preferably double rollers that mate with the track 28, i.e., see FIGS. 4, 5, 11 & 13. A roller housing 84 surrounds the rollers 82. A connecting rod or suspension bolt 86 connects the housing 84 to a clamp 88 or shoe 92 that surrounds the top edge 44 of the panel 38 to slidably suspend the panel 38 from the track 28. Generally, at least two clamps 88 or shoes 92 are required for each panel 38.

Figure 11:
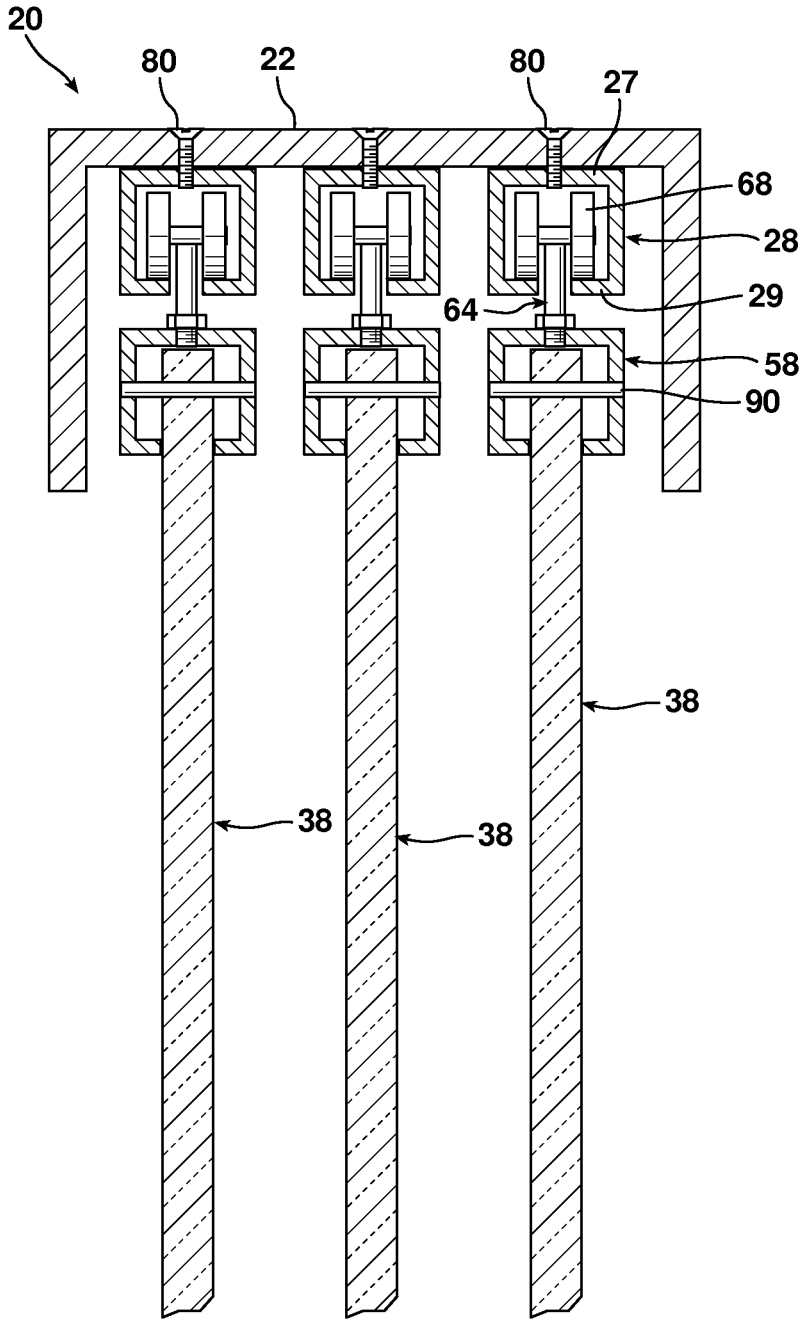
FIG. 11 is a cross-sectional view of the track beam of the space divider system of this invention taken along line 11-11 of FIG. 10 showing another embodiment of the suspension system for suspending the sliding panels from the track beam.

FIGS. 4, 5 and 11, depict one embodiment wherein the clamp 88, a "C" clamp, surrounds the top edge 44 of the panel 38. The clamp 88 is held in position by pins or rods 90 that pass through the clamp 88 and panel 38 to hold it in position.

Figure 12:
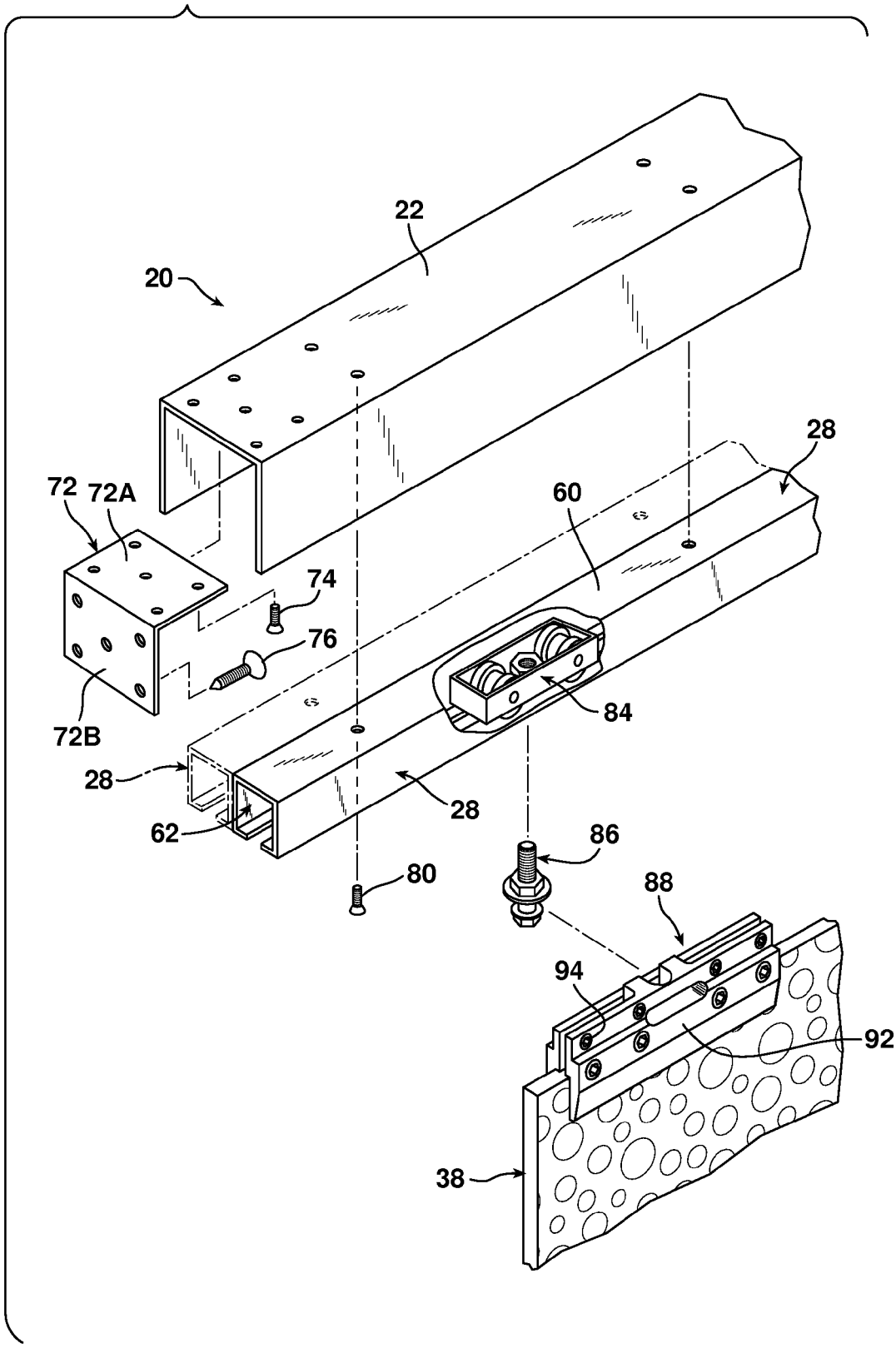
FIG. 12 is an exploded perspective view depicting the assembly of one embodiment of the suspension system used for suspending the sliding panels from the track beam of the space divider system of this invention.
Figure 13:
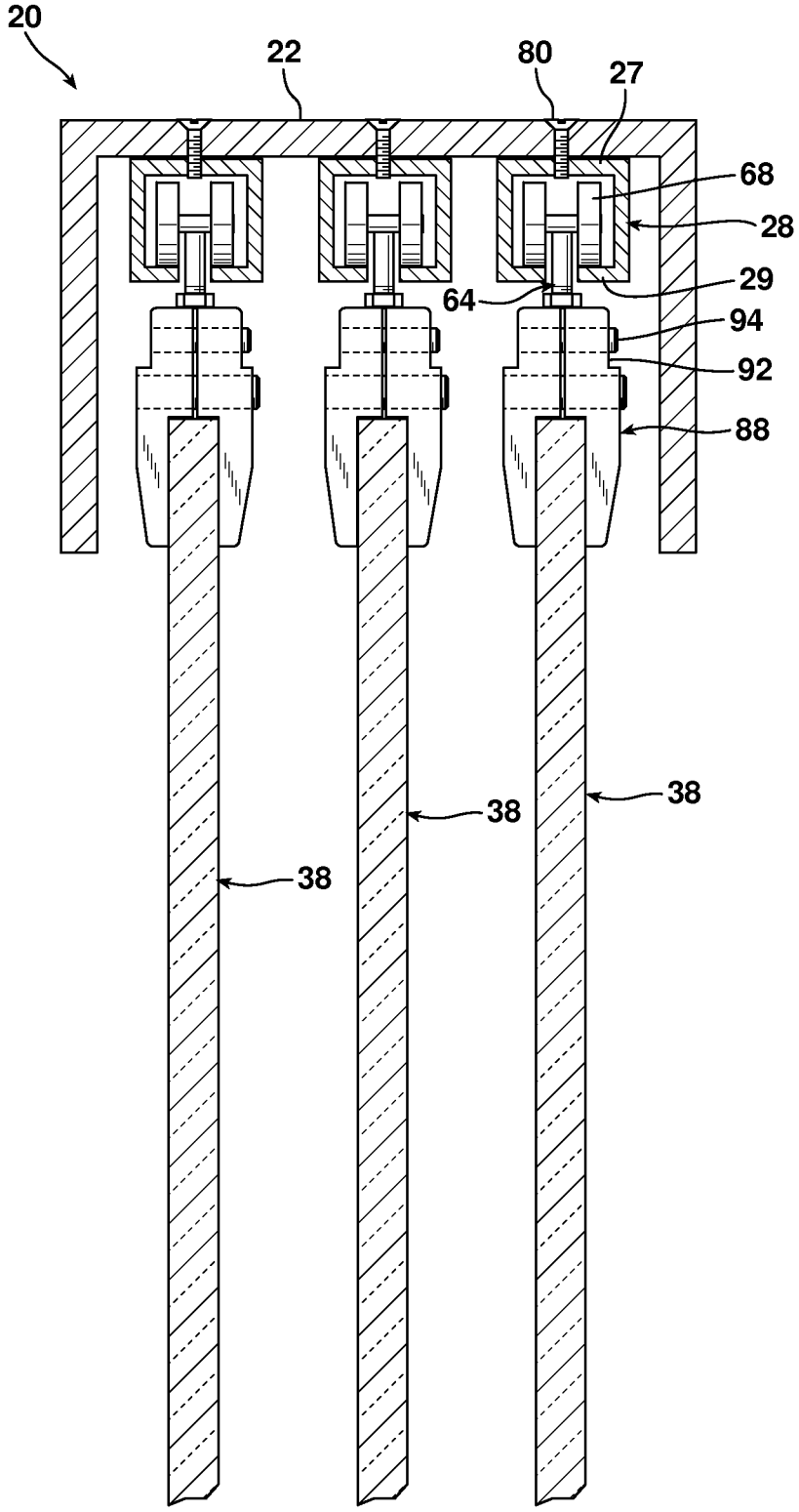
FIG. 13 is a cross-sectional view of the track beam of the space divider system of this invention showing another embodiment of the suspension system for suspending the sliding panels from the track beam.

FIGS. 12 and 13 depict another embodiment wherein a "clamp shoe" surrounds the top edge 44 of the panel 38. The clamp shoe 92 is held in position by tightening bolts 90 that passes through the clamp shoe 92 to securely clamp the panel 38. Such clamp shoes are generally known and used for sliding glass partitions and panels, see, HAWA from Häfele GmbH & Co KG (www.hafele.com), US Publication No. 2010/0101150 to Huang. Optionally, the panel 38 can have an extruded or machined groove to accommodate the clamp 88 or clamp shoe 92 (not shown).

Referring to the Figures, a plurality of translucent or transparent polymeric panels 38 are suspended from the track beam 22. Depending on the space S to be divided and the effect wanted, any number of panels 38 can be used. In the embodiment depicted, three panels 38 are depicted. Each panel 38 has opposed planar surfaces 40, 42, a top edge 44, a bottom edge 46 and opposed side edges 48 defining a width of the panel. The side edges 48 and bottom edge 46 of each panel 38 are substantially frameless.

The panels 38 used in the divider system 20 are translucent or transparent and are thus capable of transmitting light therethrough to maximize the luminosity of the interior space. This provides a sense of openness to the room and permits any designs on the panel 38 to be highlighted, while still providing a degree of privacy between the divided sections. The panels 38 are polymeric panels. They are relatively light, will not shatter like a glass panel and are generally resistant to scratching and scuffing. The panels 38 can have numerous textured effects, patterns, designs, clear, custom graphics, and honeycombs molded into the panels. The panels 38 can be provided with a continuous design across the plurality of panels 38.

Preferred panels 38 are ECORESIN® panels manufactured and sold by 3Form, Inc. (Salt Lake City, Utah). These panels are translucent thermoplastic panels that are used in decorative architectural applications, such as splashes, appliance panels, shower surrounds, privacy panels, cabinet doors, raised panel inserts, flooring, office furniture panels, chairs, tables, art, stained glass type windows, signage, store displays, store fronts, transaction tops and desks (www.3-form-.com). Some of 3Form's numerous US Patents and publications on these panels are U.S. Pat. Nos. 7,504,159 and 7,691,486 and US Publication No. 2010/0143662 to Suare et al and US Publication No. 2011/0226424 to Willham. The entire disclosures of these patents and publications are incorporated herein by reference. Other brands and/or manufacturers produce and sell such panels, e.g., Panelite® from Panelite, LLC. (www.e-panelite.com).

The preferred panels 38 are lightweight and made of "environmentally friendly" resins, e.g., resins that contain a substantial portion of recycled resin and are translucent or transparent. These preferred panels 38 are described as having have at least about 40% pre-consumer recycled content, are half the weight of glass, have about 40 times the impact strength of glass and are heat formable. Preferably the panels 38 used in this invention are approximately 4 feet (approximately 1.219 meters) by 8 feet (2.438 meters) and 0.25 inches (0.635 centimeter) to 0.75 inches (1.905 centimeters) in thickness. Typically, the panels are about half the density of glass. However the densities can be modified to control the translucency and the performance of the panels in the space divider system 20 of this invention.

Generally, the preferred panels range in thickness from ¼ inch (6.3 mm) to ¾ inch (19.05 mm) and have a weight of 1.7 lb/ft$^2$ (8.3 kg/m$^2$) to 3.2 lb/ft$^2$ (15.62 kg/m$^2$).

Preferred panels 38 are 3 Form Varia Ecoresin® and 3 Form Struttura®. For example, the preferred Ecoresin® has a panel weight, depending on thickness of the panel, that ranges from 1.7 lb/ft$^2$ (8.3 kg/m$^2$) to 2.5 lb/ft$^2$ (12.2 kg/m$^2$):

| | |
|---|---|
| ¼" (6.3 mm) | 1.7 lb/ft$^2$ (8.3 kg/m$^2$) |
| ⅜" (9.5 mm) | 2.5 lb/ft$^2$ (12.2 kg/m$^2$) |

The highly preferred thicknesses for Varia Ecoresin® are from ¼ inch (0.635 centimeter) to ⅜ inches (0.9525 centimeter), i.e., 1.7 lb/ft$^2$ (8.3 kg/m$^2$) to 2.5 lb/ft$^2$ (12.2 kg/m$^2$)

Other preferred panels 38 are 3 Form Struttura®. For example, the preferred Struttura® has a panel weight that ranges from 2.55 lb/ft$^2$ (12.45 kg/m$^2$) to 3.2 lb/ft$^2$ (15.62 kg/m$^2$) for a preferred thickness of ¾ inch.

For comparative purposes, glass weight is typically as follows:

| | |
|---|---|
| ¼" (6.3 mm) | 3.4 lbs/ft |
| ⅜" (9.5 mm) | 5.1 lbs/ft |
| ¾" (19 mm) | 10.2 lbs/ft |

Another element of the divider system 20 of this invention is that the side edges 48 and bottom edge 46 of each panel 38 are substantially frameless. There are no frames around the panel 38 to interfere or obstruct the passage of light through the panels 38. Such "frameless" panels 38 also assist in providing the panels 38 with the look of a continuous mural or continuous panel effect.

By the use of the term "frameless" it is meant that the panels 38 do not have any rigid frame members over substantially all the side edges 48 and bottom edge 46 of the panel 38. "Frameless" contemplates that short portions of the panels 38 may have a rigid frame portion thereon to accomplish a specific function that does not interfere with the use of frameless panels in this invention. For example, a short gripping surface may be placed at an appropriate place on the edge of the panel. The "frameless" panels 38 of this invention provide the following benefits:

a) By hanging the preferred panels 38, i.e., ¼" (6.3 mm) to ¾ inch (19.05 mm), from the top edge 44 the natural tendency of the panel 38 is to remain flat without bowing or distortion, i.e., frameless panels 38 remain naturally straight.

b) By not having a frame around the edges 46, 48 the panels 38 have an uninterrupted surface quality, creating a continuous effect similar to a seamless mural.

c) The frameless panels 38 allow for greater luminosity since more light can come through the translucent or transparent panel 38 surface and since there are no frames around the panel a greater amount of light can pass through when they overlap each other.

d) The lower edge of the frameless panels 38 does not require any floor track or lower support, avoiding the need to disrupt floor surfaces. The bottom edges 46 of the panels 38 are spaced a distance 54 from the floor surface. Preferably, the panels 38 hover about 0.5 inches (about 1.27 centimeters) above the floor surface FS and swing slightly if moved, but will come to a stop after a few seconds.

Reference is made to FIGS. 6 through 9 which are schematic top views of the space divider system 20 of this invention mounted between opposed walls W1, W2 and depict various configurations of a system 20 having three panels 38. Each panel 38 slides freely and independently of each other along the track beam 22 which extends the complete length of the track beam 22; each panel 38 sliding on its own individual track 28 from which it is suspended. This permits numerous configurations of the panels 38.

Generally, the widths 50 of each panel 38 when added together are at least about equal to the length 30 of the track beam 22. This permits the panels 38 to be positioned along the track beam 22 to provide for the complete closure of the space between the walls W1, W2. Additionally, the widths 50 of each panel 38 are such that they can be positioned along the track beam 22 to overlap each other and provide openings through the space S between the walls W1, W2.

Figure 6:
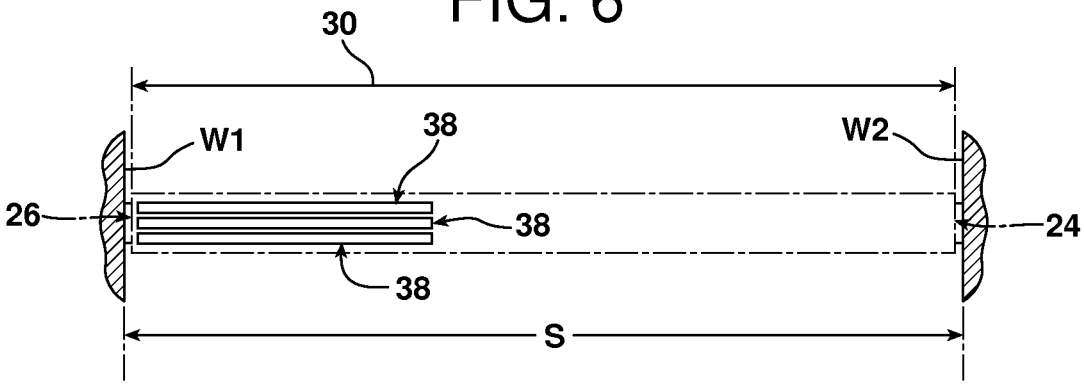
FIGS. 6-9 are schematic top views of the space divider system of this invention mounted between opposed wall surfaces depicting various configurations of the sliding panels to provide various openings and a closure in the space between the walls.

For example, in FIG. 6, all three panels are pushed to one side leaving open about two-thirds of the space S between the walls W1, W2.

Figure 7:
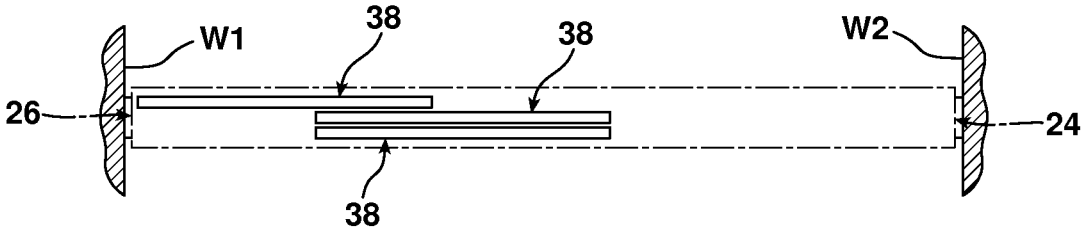

FIG. 7 depicts one panel slid all the way to one side and two of the panels overlapping in the middle of the beam. This leaves open about one-third of the space S between the walls W1, W2.

Figure 8:
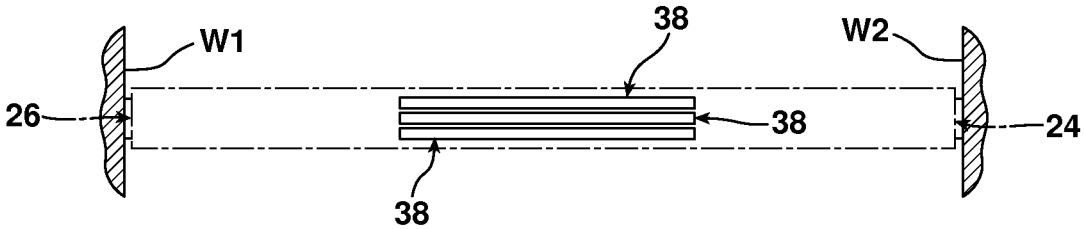

FIG. 8 depicts all three panels stacked in the middle, leaving about one-third of the space S open on each side of the panels.

Figure 9:
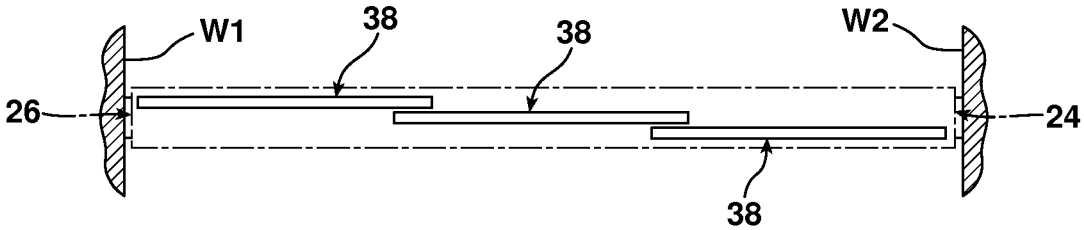
Figure 10:
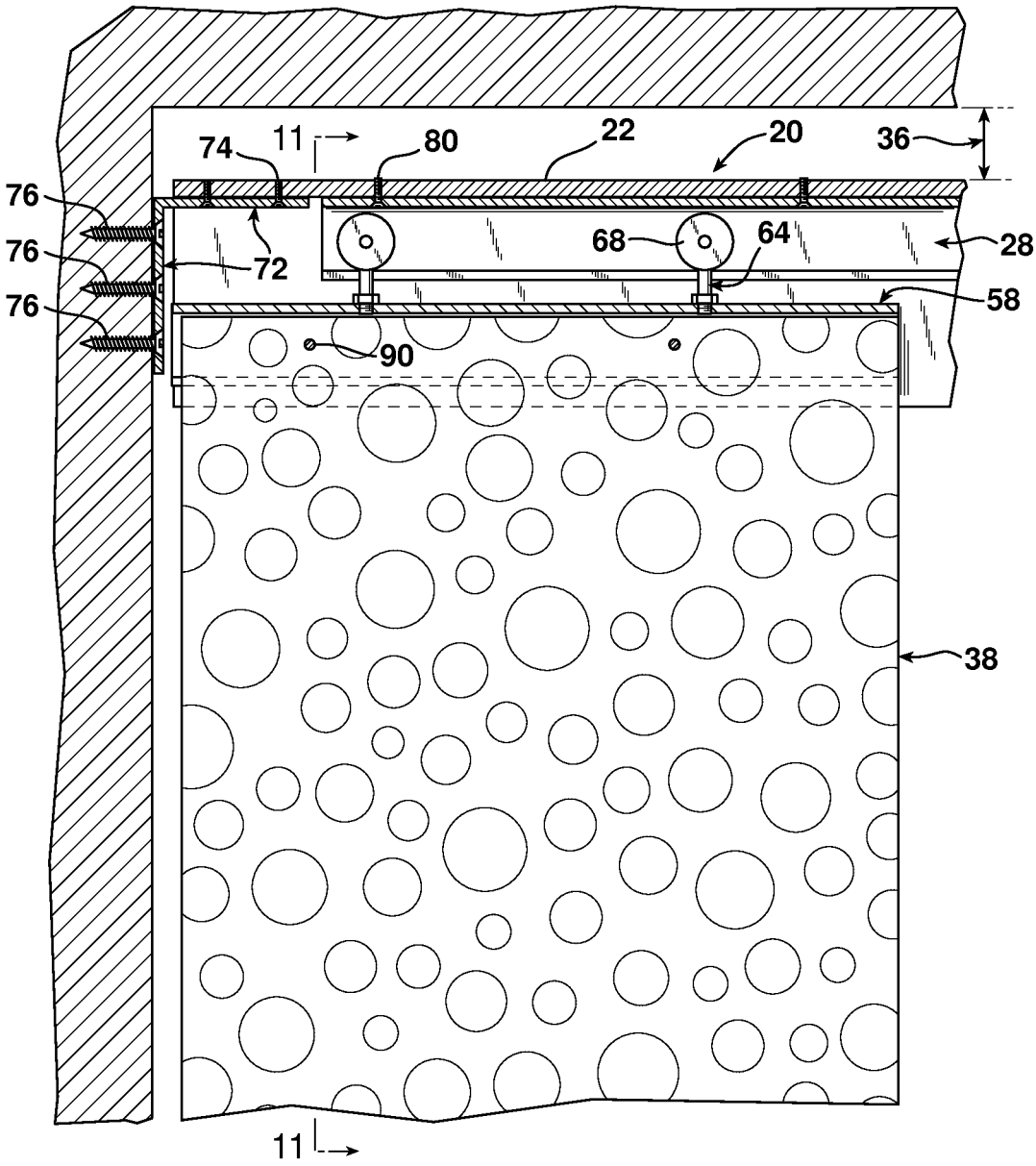
FIG. 10 is a partial cross-sectional view of another embodiment of the suspended track beam of the space divider system of this invention mounted to a wall or door jam.

FIG. 9 depicts the panels positioned to completely close the opening space S between W1, W2.

As can be seen, each of the panels can be maneuvered on its own individual track to configure the openings and closed portions as desired.

While various changes may be made in the detailed construction and processes of this invention, it will be understood that such changes will be within the spirit and scope of the present invention. Having thus described the invention in detail, it is to be understood that the foregoing description is not intended to limit the spirit and scope thereof. What is desired to be protected by Letters Patent is set forth in the appended claims.

What is claimed:

1. A space divider system that allows uninterrupted passage of light therethrough, mounted in an opening between rooms through which a person may move, the opening having a ceiling surface, a floor surface and opposed wall surfaces that form a space between the wall surfaces, the divider system comprising:

an elongated track beam having opposed ends and a plurality of parallel tracks along the track beam length, the track beam suspended below the ceiling surface without intermediate support and attached only to the opposed wall surfaces, each end having means for removably mounting the end of the track beam to an opposed wall surface to mount the track beam across the space between the walls and to mount the track beam a spaced distance below the ceiling surface;

a plurality of translucent or transparent rigid panels, each panel having opposed planar surfaces, a top edge, a bottom edge and opposed side edges defining a width of the panel, wherein the side edges and bottom edge of each panel are substantially frameless, the panels permitting the uninterrupted the passage of light between the rooms;

a suspension system mounted to each panel near the top edge of the panel for slidably mounting the panel to one of the tracks of the track beam, whereby each panel slides between the opposed wall surfaces on its own track independently of the other panels, the planar surfaces of the panel being substantially parallel to the track beam, the bottom edge of the panel spaced a distance from the floor surface;

wherein the widths of each panel when added together are at least about equal to the track beam length and the panels can be positioned along the beam length to allow complete closure of the space between the walls while permitting the uninterrupted passage of light;

wherein the track beam supports the translucent or transparent panels across the space opening, and wherein the widths of each panel are such that they can slide along the beam length and be positioned to overlap each other providing an opening through the space between the walls, through which a person may move between the rooms, the opening located at selective positions between the wall space.

2. The space divider of claim 1, wherein the suspension system comprises:

a length of channel having a closed top surface and an open end along its length, the open end of the channel mounted to the top edge of the panel;

a suspension rod having one end mounted to the top surface of the channel and a roller mounted at the other end of the suspension rod, the roller slidably mounted to the track of the track beam.

3. The space divider of claim 1, wherein the suspension system comprises:

a clamp shoe having a top end and an open bottom end frictionally mounted to the top edge of the panel;

a suspension rod having one end mounted to the top end of the clamp shoe and a roller mounted at the other end of the suspension rod, the roller slidably mounted to the track of the track beam.

4. The space divider of claim 1, wherein the means for removably mounting is an L-shaped bracket having a first leg and a second leg, the first leg of the bracket mounted to the end of the track beam and the second leg of the bracket mounted to the wall surface.

5. The space divider of claim 1, wherein each track extends substantially the full length of the track beam and the panel mounted on such track can slide the complete length of such track.

6. The space divider of claim 1, wherein the panels are textured.

7. The space divider of claim 1, wherein the panels comprise at least about 40% pre-consumer recycled polymers.

8. The space divider of claim 1, wherein the panels range in thickness from ¼ inch (6.3 mm) to ¾ inch (19.05 mm) and have a weight of 1.7 $lb/ft^2$ (8.3 $kg/m^2$) to 3.2 $lb/ft^2$ (15.62 $kg/m^2$).

* * * * *